US006557973B1

(12) United States Patent
Elgee

(10) Patent No.: US 6,557,973 B1
(45) Date of Patent: May 6, 2003

(54) PRINT MODE FOR FULL BLEED

(75) Inventor: Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/580,397

(22) Filed: May 26, 2000

(51) Int. Cl.[7] ..... B41J 2/145; B41J 2/15; B41J 29/38

(52) U.S. Cl. ..... 347/41; 347/9

(58) Field of Search ..... 347/41, 9, 12, 347/14

(56) References Cited

U.S. PATENT DOCUMENTS 5,870,112 A * 2/1999 Kang et al. ..... 347/9
6,050,675 A * 4/2000 Bartolome ..... 347/41
6,086,181 A * 7/2000 Majette et al. ..... 347/16

FOREIGN PATENT DOCUMENTS

| | | |
|---|---|---|
| EP | 0616893 | 9/1994 |
| EP | 0665114 | 8/1995 |
| EP | 0824073 | 2/1998 |
| EP | 0992347 | 4/2000 |
| EP | 1024010 | 8/2000 |
| EP | 1059168 | 12/2000 |

* cited by examiner

*Primary Examiner*—Thinh Nguyen

(57) ABSTRACT

A method of ink jet printing wherein at least one row of pixels adjacent a leading edge of a print medium and/or trailing edge of the print medium is printed using a print mode that employs fewer passes than the print mode utilized for printing rows that are further from such edges.

12 Claims, 3 Drawing Sheets

PRINT MODE FOR FULL BLEED

BACKGROUND OF THE INVENTION

The disclosed invention is generally directed to ink jet printing, and more particularly to a technique for ink jet printing that reduces the amount of ink that is deposited off a print medium in edge to edge printing.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

For a variety of reasons including avoidance of drop to drop ink interaction, and compensation for print mechanism mechanical errors and printhead errors, ink jet printing commonly employs multiple-pass print modes wherein the pixels of a row are printed in multiple passes or scans of the ink jet printheads. In other words, as to a row of pixels, the printed pattern of a given color is filled pursuant to multiple passes of the printheads wherein only a portion of the printed pattern is filled in each pass. Typically, the print medium is advanced between passes of the printheads, for example by a fraction of a swath height which is the extent along the media advance axis that a printhead can print in a single pass. For example, in a four pass print mode, a pixel row is printed in four passes and the print medium is advanced one-fourth of a swath between passes.

A consideration with multiple pass print modes is the accumulation of print media positioning errors whereby the dots printed on one pass are not precisely aligned along the media with the dots printed on another pass. When edge to edge or "full bleed" printing is being performed, this can lead to excessive amounts of ink being deposited off the leading edge and trailing edge of the print media onto the media handling mechanism of the printer. Such off-media ink deposition causes unwanted marking of the back side of print media subsequently printed, which is deleterious to double sided printing. Also, the off-axis deposition of ink could cause the media advance mechanism to malfunction.

There is accordingly a need to reduce off-media printing in ink jet printers.

SUMMARY OF THE INVENTION

The disclosed invention is directed to a method of ink jet printing wherein at least one pixel row adjacent an edge of a print medium is printed using a print mode that employs fewer passes than a print mode utilized to print pixel rows that are further from such edge.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
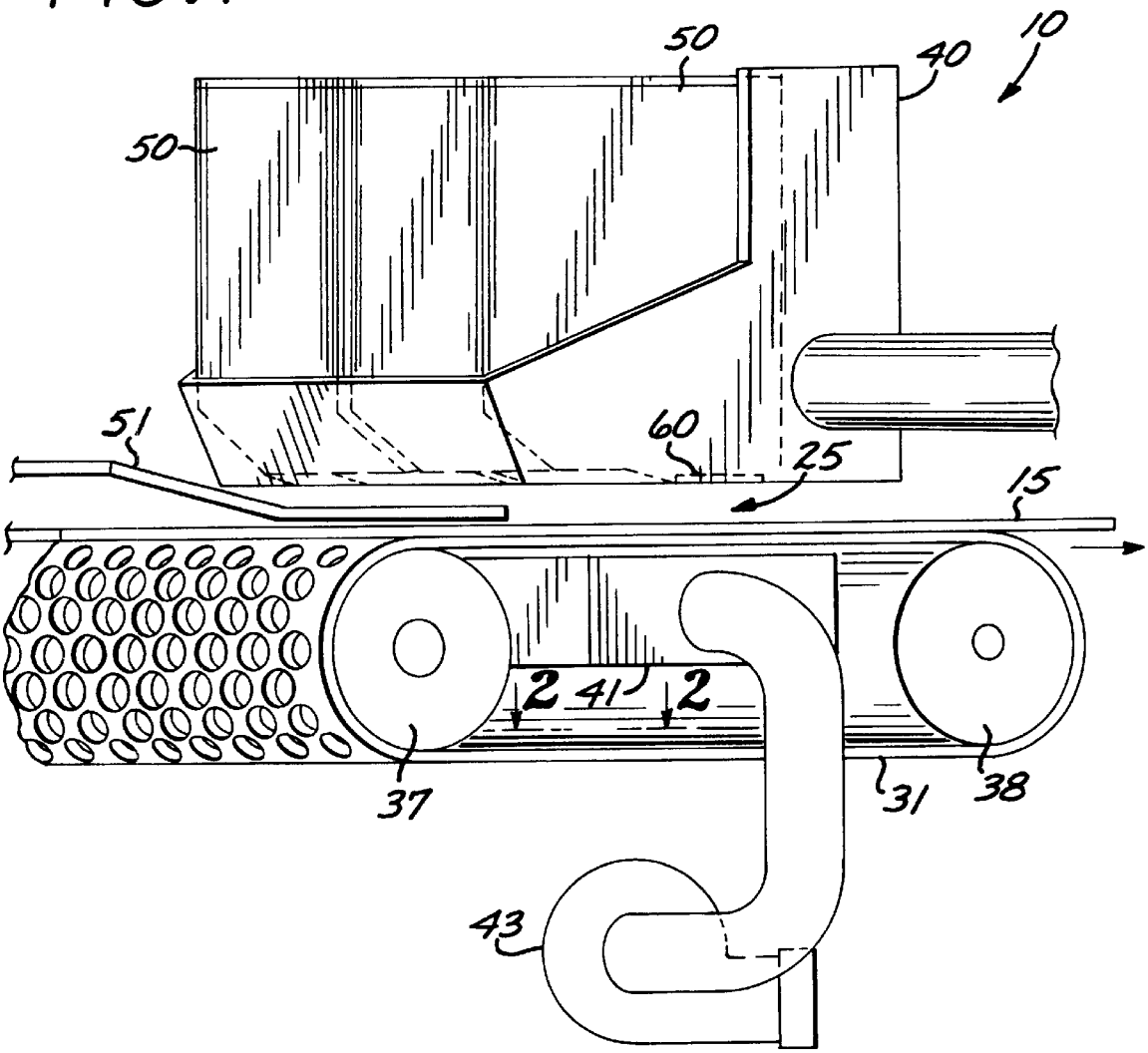
FIG. 1 is a schematic depiction of an ink jet printing device in which the disclosed invention can be employed.

In the following detailed description and in the several figures of the drawing, like elements are identified with like reference numerals.

Figure 4:
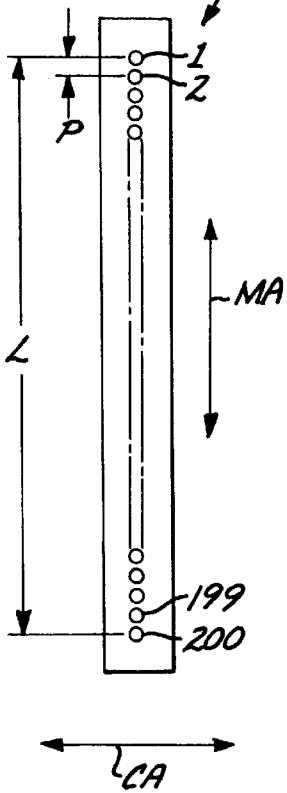
FIG. 4 is a schematic depiction of an ink jet nozzle array of the printer of FIG. 1.

FIG. 1 is a schematic depiction of an exemplary ink jet printing device 10 in which the disclosed invention can be employed. The ink jet printing device includes one or more ink jet print cartridges 50 that are supported by a print carriage 40 mounted on a slider rod 38 for reciprocating movement along a carriage axis CA (FIG. 4). Each of the ink jet print cartridges 50 includes an ink jet printhead 60 having a plurality of ink drop generators for depositing ink jet dots on a print medium 15 (e.g., paper) that is tightly held on a media supporting belt 31 by vacuum. Each ink drop generator can be comprised of a heater resistor, an ink chamber, and a nozzle. In accordance with an aspect of the invention, the operation of the ink generators is controlled such that the dot or pixel row immediately adjacent the leading edge of the print medium 15 and the dot row immediately adjacent the trailing edge are each printed using fewer passes than the number of passes used to print pixel rows that are further from such edges.

Figure 2:
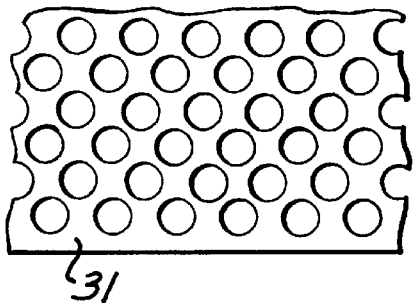
FIG. 2 is a plan view illustrating a portion of the media supporting endless belt of the ink jet printing system of FIG. 1.

The print medium 15 is more particularly supported and advanced through the print zone 25 by an endless belt media transport subsystem that includes an endless perforated belt 31 (also shown in FIG. 2) mounted for rotation on belt pulleys 37, 38 that are driven to advance the print medium 15. The print medium 15 is picked from an input supply (not shown) and its leading edge is delivered to a guide 51 that is configured to deliver the leading edge of the print medium 15 to the endless belt 31. An optional pinch roller may be used to assist transport of the print medium 15 through the print zone along a media axis MA. A vacuum plenum 41 that is coupled to a vacuum inducing pump 43 holds the print medium 15 tightly against the belt surface at the print zone. An output roller may be optionally used to receive the leading edge of the print medium 15 and continue the transport of the print medium until the trailing edge of the print medium is released.

Figure 3:
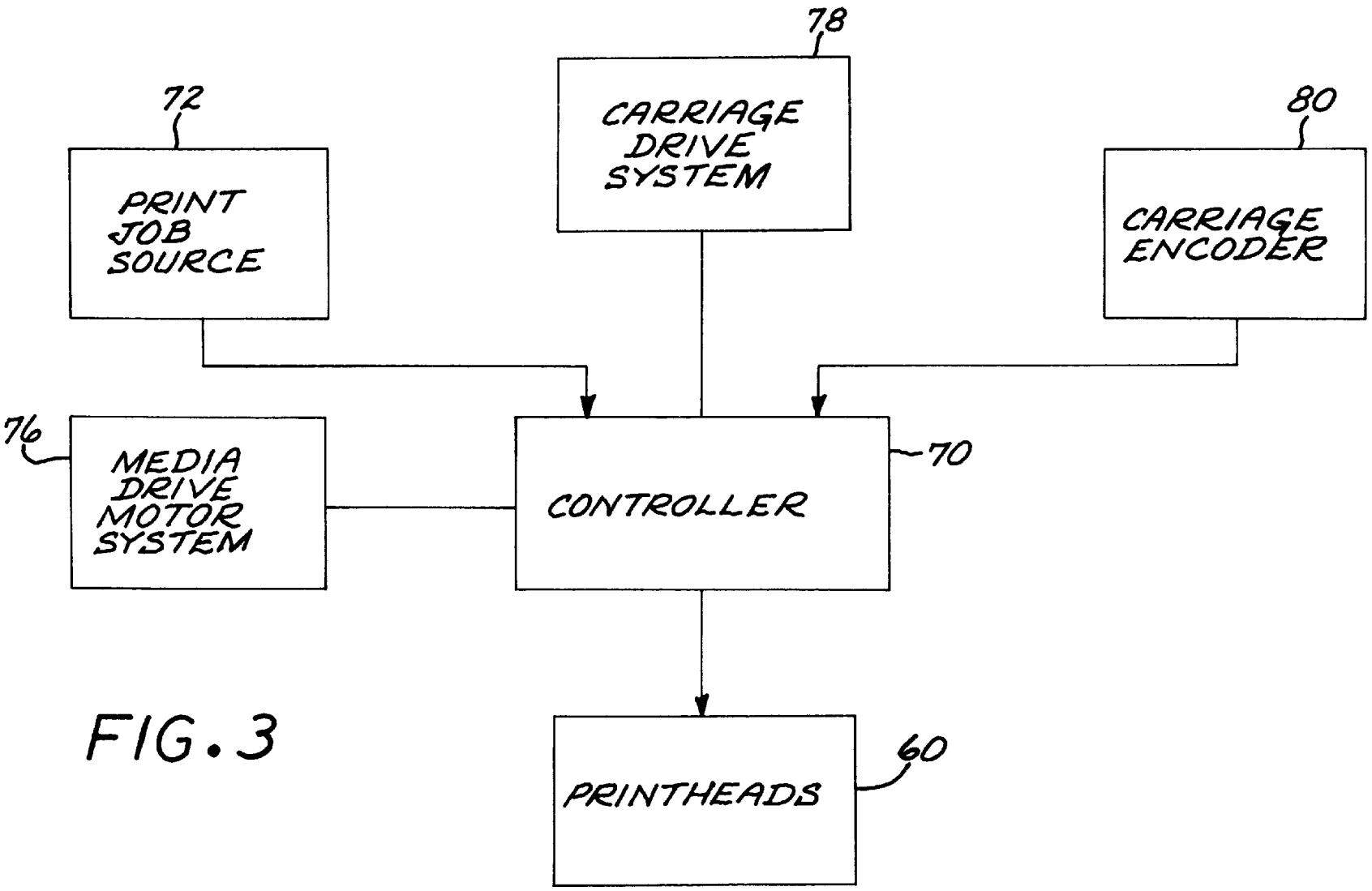
FIG. 3 is a block diagram of a control system for the printing device of FIG. 1.

FIG. 3 is a schematic block diagram of a control system for the printer of FIG. 1. A controller 70 such as a microcomputer receives print job commands and data from a print job source 72, which can be a personal computer, digital camera or other source of print jobs. The controller 70 acts on the received commands and data to activate a media drive motor system 76 to advance the print medium onto the belt, and move the belt to advance the sheet through the print zone. A carriage drive system 78 is controlled by the controller 70 to scan the carriage 40 along the slider rod 38.

As the carriage 40 moves, firing signals are sent to printheads 60 of the print cartridges 50. The controller receives encoder signals from a carriage position encoder 80 to provide position data for the print carriage 40. The controller 70 is programmed to incrementally advance the print medium 15 to position the print medium for successive scans of the print carriage across the print medium.

Referring now to FIG. 4, each of the printheads 60 of the print cartridges 50 of the printer of FIG. 1 includes an array 70 of ink jet nozzles having a center to center spacing or pitch P along the media axis MA, and a nozzle array length L. For illustration purposes and for ease of reference, the nozzle array 60 includes 200 nozzles that are sequentially numbered in such a manner that nozzle 200 first encounters the print medium 15 as it is advanced along the media axis MA.

Figure 5:
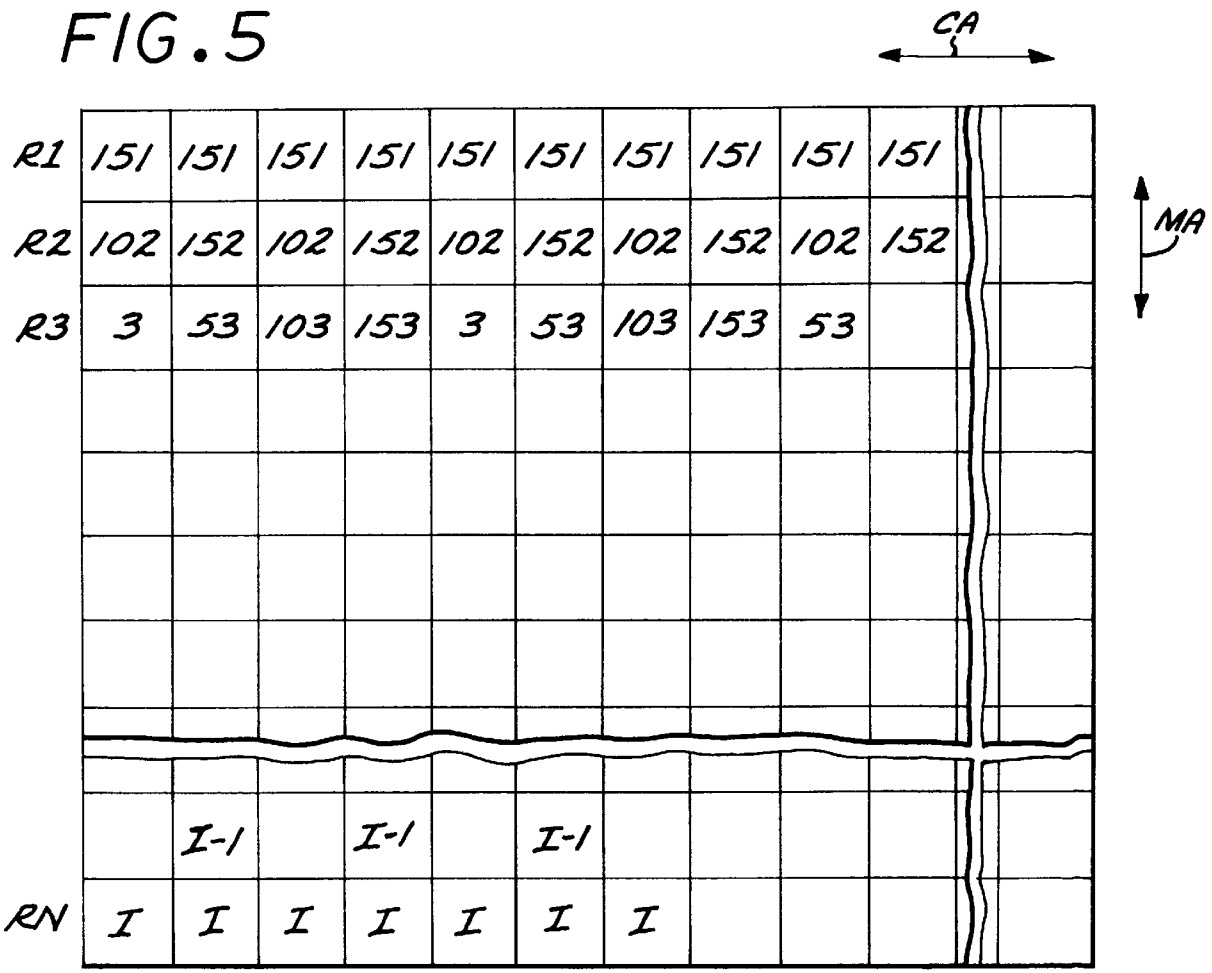
FIG. 5 schematically depicts a pixel array that would be printed utilizing a printing method in accordance with the invention.

Referring now to FIG. 5, the printer forms an image by scanning the print carriage 40 along the carriage axis and printing dots at selected pixel locations P of a two-dimensional pixel array A defined for the image to be printed. The pixel locations or pixels P are arranged in rows and columns, wherein the rows are aligned with the carriage scan axis and the columns are aligned with the media axis. The number of pixels per unit distance along the carriage scan axis is referred to as the carriage axis resolution, while the number of pixels per unit distance along the media axis is referred to as the media axis resolution. The center to center distance between adjacent columns is the carriage axis dot pitch, while the center to center distance between adjacent rows is the media axis dot pitch. By way of illustrative example, the media axis dot pitch is substantially equal to nozzle pitch of the printheads 50.

For ease of reference, the pixel rows are sequentially numbered starting with row R1 that is adjacent the leading edge 15 of the print medium 15, which is the edge that first enters the print zone.

It should be appreciated that an image is formed of a pattern of dots deposited on the pixel array, and the pixel locations that receive dots are sometimes referred to as pixels that are "on". Also, it is sometimes convenient to refer to the pixel rows of the image that is being printed, wherein each pixel row contains an appropriate pattern of pixels for that image.

FIG. 5 more particularly depicts an illustrative example of a printing procedure in accordance with the invention utilizing a 200 nozzle printhead. A numeral in a pixel location identifies the particular nozzle that would print that pixel if such pixel were "on" (i.e., to be printed). The print medium is advanced such that nozzles 151 through 200 (which comprise one-fourth of the nozzle array length) will traverse a leading portion of the print medium 15, with nozzle 151 aligned along the carriage axis with the first pixel row R1.

The print carriage 40 is scanned, and while the carriage is scanned, the first pixel row R1 is printed at a 100 percent or less density using nozzle 151, the second pixel row R2 is printed at a 50 percent density using nozzle 152, and the pixel rows R3 through R50 are printed at 25 percent density using nozzles 153 through 200. As is well known, when a pixel row is printed at 50 percent density in a particular pass or scan, about 50 percent of the "on" pixels of that row are printed in that one pass.

Similarly, when a pixel row is printed at 25 percent density in a particular pass or scan, about 25 percent of the "on" pixels of the row are printed in that pass. When a pixel row is printed at 100 percent density in a particular pass, all of the "on" pixels of that row are printed in that pass. It is also well known that if a particular row is printed at less than 100 percent density in a particular pass, then multiple passes would be required if the particular row is to be fully populated (i.e., all pixels of the particular row of the image are to be printed).

The print medium is then advanced by a one-fourth of the active nozzle array length which for illustrative purposes is 200 nozzles, and the print carriage is scanned. As the carriage is scanned, row R2 is printed at a 50 percent density using nozzle 102, and rows R3 through 100 are printed at a 25 percent density using nozzles 103 through 200. No pixels in row R1 are printed, even if row R1 was printed at less than 100 percent density on the previous pass.

Thus, the first pixel row R1 is printed with a one-pass print mode wherein the first pixel row of the image is printed in a single pass at 100 percent or less density, while the second pixel row of the image is printed with a two-pass print mode. The third and subsequent rows are printed using a four-pass print mode. Alternatively, the second pixel row R2 can be printed using a one-pass print mode, whereby in the above example pixel row R2 would be printed at 100 percent or less density in a single pass using the nozzle 152.

Similarly, the last pixel row RN is printed at 100 percent or less print density with a one-pass print mode using an $1^{th}$ nozzle. The next to last pixel row RN-1 can be printed with a one-pass or two-pass print mode. If a one pass-print mode is used to print the next to last pixel row RN-1, print density can be 100 percent or less.

If a two pass mode is employed for the third and succeeding rows, then prior to printing the print medium is advanced such that nozzles 101 through 200 (which comprise one-half of the nozzle array length) will traverse a leading portion of the print medium 15, with nozzle 101 aligned along the carriage axis with the first pixel row R1.

The print carriage 40 is scanned, and as the carriage is scanned, row R1 is printed at a 100 percent density using nozzle 101, and rows R2 through R100 are printed at a 50 percent density using nozzles 102 through 200. The print medium is then advanced by one-half of the active nozzle array length which for illustrative purposes is 200 nozzles, and the print carriage 40 is scanned. As the carriage is scanned, rows R2 through R200 are printed at a 50 percent density using nozzles 2 through 200.

Broadly, the invention contemplates that one or more pixel rows adjacent a leading edge or trailing edge of the print medium be printed using a respective print mode for each of the one or more pixel rows that employs fewer passes than a print mode utilized to print pixel rows that are further from the leading edge or trailing edge. In a previously described example, the first row is printed using a one-pass print mode, a second row is printed using a two-pass print mode, and rows further from the edge are printed using a four-pass print mode. The invention also contemplates that each of the one or more pixel rows adjacent a leading or trailing edge that is printed using fewer passes than the rows further from the edges can be printed at less than 100 percent density. Thus, example, a row adjacent an edge can be printed at less than 100 percent density using a two-pass print mode, in which case each pass would print less than 50 percent density.

While the foregoing has been described in the context of a printer having a vacuum belt media advance system, it should be appreciated that the invention can be employed with other types of media advance systems including conventional pinch roller systems.

The foregoing has thus been a disclosure of a printing technique advantageously reduces the amount of ink that is deposited off a print medium in edge to edge printing.

Although the foregoing has been a description and illustration of specific embodiments of the invention, various modifications and changes thereto can be made by persons skilled in the art without departing from the scope and spirit of the invention as defined by the following claims.

What is claimed is:

1. A method of printing an image on a print medium with a scanning printhead, wherein the image is comprised of a pattern of dots, comprising the steps of:

printing a first plurality of rows of dots of the image adjacent an edge of the print medium, each row being printed using a respective M-pass print mode; and printing a second plurality of rows of dots of the image that are further from the edge than the first plurality of rows using an N-pass print mode, wherein N is greater than M.

2. The method of claim 1 wherein the step of printing a first plurality of rows of dots includes the step of printing a plurality of rows of the image adjacent an edge of the print medium at less than 100 percent print density, each row being printed using a respective M-pass print mode.

3. The method of claim 1 wherein the step of printing a first plurality of rows of dots includes the steps of printing a first row of dots of the image adjacent an edge of the print medium using a two-pass print mode.

4. The method of claim 1 wherein the step of printing a first plurality of rows of dots includes the step of printing a first plurality of rows of dots of the image adjacent a leading edge of the print medium, each row being printed using a respective M-pass print mode.

5. The method of claim 1 wherein the step of printing a first plurality of rows of dots includes the step of printing a first plurality of rows of dots of the image adjacent a trailing edge of the print medium, each row being printed using a respective M-pass print mode.

6. A method of printing an image on a print medium with a scanning printhead, wherein the image is comprised of a pattern of dots, comprising the steps of:

printing a single row of dots of the image adjacent an edge of the print medium using an M-pass print mode; and printing a plurality of rows of dots of the image that are further from the edge than the single row using an N-pass print mode, wherein N is greater than M.

7. The method of claim 6 wherein the step of printing a single row of dots comprises the step of printing a single row of dots adjacent an edge of the print medium at less than 100 percent density using an M-pass print mode.

8. The method of claim 6 wherein the step of printing a single row of dots includes the step of printing a single row of dots of the image adjacent a leading edge of the print medium an M-pass print mode.

9. The method of claim 6 wherein the step of printing a single row of dots includes the step of printing a single row of dots of the image adjacent a trailing edge of the print medium an M-pass print mode.

10. A method of printing an image on a print medium with a scanning printhead, wherein the image is comprised of a pattern of dots, comprising the steps of:

printing a first plurality of rows of dots of the image adjacent an edge of the print medium, each row being printed using a respective M-pass print mode, said printing including;

printing a first row of dots of the image adjacent an edge of the print medium using a one-pass print mode; and printing a second row of dots of the image adjacent the first row of dots using a two-pass print mode; and printing a second plurality of rows of dots of the image that are further from the edge than the first plurality of rows using an N-pass print mode, wherein N is greater than M.

11. The method of claim 10 wherein the step of printing a first plurality of rows of dots includes printing said first row of dots of the image adjacent an edge of the print medium at less than 100 percent using the one-pass print mode.

12. A method of printing an image on a print medium with a scanning printhead, wherein the image is comprised of a pattern of dots, comprising the steps of:

printing a single row of dots of the image adjacent an edge of the print medium using a one-pass print mode; and printing a plurality of rows of dots of the image that are further from the edge than the single row using an N-pass print mode, wherein N is greater than one.

* * * * *